US005662233A

United States Patent [19]

Reid

[11] Patent Number: 5,662,233

[45] Date of Patent: Sep. 2, 1997

[54] WINE BOTTLE CLOSURE

[75] Inventor: Grahame W. Reid, Novato, Calif.

[73] Assignee: Innovative Molding, Inc., Sebastopol, Calif.

[21] Appl. No.: 421,492

[22] Filed: Apr. 12, 1995

[51] Int. Cl.[6] ..... B65D 45/00

[52] U.S. Cl. ..... 215/273; 215/217; 215/247; 215/277

[58] Field of Search ..... 116/203, 212; 222/153.06, 541.5; 215/204, 209, 211, 222, 232, 250, 252, 253, 295, 296, 325, 326, 329, 332, 330, 331, 230, 43–45, 277, 341, 343, 344, 350, 351, 354, 355, 356, 357, 273, 217–219; 220/254, 255, 256, 257, 265, 288, 293, 307, 308, 301

[56] References Cited

U.S. PATENT DOCUMENTS

| | | | |
|---|---|---|---|
| 1,942,810 | 1/1934 | Gibbs . | |
| 2,742,170 | 4/1956 | Bramming | 215/277 X |
| 2,987,175 | 6/1961 | Bottum | 215/277 X |
| 3,339,772 | 9/1967 | Miller . | |
| 3,499,568 | 3/1970 | Vinas Riera . | |
| 3,589,983 | 6/1971 | Holderith et al. . | |
| 3,612,325 | 10/1971 | Williams . | |
| 3,695,475 | 10/1972 | Ruekberg | 215/222 X |
| 3,736,899 | 6/1973 | Manske . | |
| 3,831,796 | 8/1974 | Claasen . | |
| 3,946,891 | 3/1976 | Picoy et al. . | |
| 4,084,717 | 4/1978 | King | 215/217 |
| 4,373,641 | 2/1983 | Banich, Sr. et al. | 215/331 |
| 4,436,401 | 3/1984 | Taylor | 220/293 X |
| 4,493,427 | 1/1985 | Wolkonsky . | |
| 4,605,135 | 8/1986 | Ryder . | |
| 4,664,276 | 5/1987 | Taragna et al. . | |
| 4,733,787 | 3/1988 | Knopf et al. | 220/257 X |
| 4,767,016 | 8/1988 | Cook, Jr. et al. | 215/230 |
| 4,771,923 | 9/1988 | Zinnbauer | 222/153.06 |
| 4,809,858 | 3/1989 | Ochs . | |
| 4,812,408 | 3/1989 | Hammann et al. . | |
| 4,830,970 | 5/1989 | Madaus et al. . | |
| 4,834,251 | 5/1989 | Yu | 215/222 |
| 4,844,273 | 7/1989 | Hawkins | 215/329 |
| 4,948,000 | 8/1990 | Grabenkort . | |
| 5,012,942 | 5/1991 | Druesne et al. | 215/326 X |
| 5,071,017 | 12/1991 | Stuli | 215/247 X |
| 5,080,245 | 1/1992 | Conard . | |
| 5,096,083 | 3/1992 | Shaw et al. | 215/217 X |
| 5,269,429 | 12/1993 | Schumacher . | |
| 5,431,305 | 7/1995 | Kaminski | 222/153.06 X |
| 5,455,180 | 10/1995 | Reid | 215/247 X |
| 5,480,915 | 1/1996 | Burns | 215/355 X |

FOREIGN PATENT DOCUMENTS

| | | |
|---|---|---|
| 1237031 | 6/1960 | France . |
| 2444081 | 8/1980 | France . |
| 2541318 | 3/1977 | Germany . |
| 3123902 | 6/1982 | Germany . |

*Primary Examiner*—Gary E. Elkins
*Attorney, Agent, or Firm*—Thomas M. Freiburger

[57] ABSTRACT

A wine closure replaces the traditional cork and foil and includes a gasket/stopper which engages into the neck of the bottle. Encasing the finish and upper neck of the bottle is a plastic outer closure cap, generally cylindrical, with a top center disc which is adhered to the top of the stopper. A circle of frangible elements at the periphery of the disc provide for breakage of the disc away from the sleeve, causing it to remain with the stopper when the plastic cap is opened. Coarse, short-length threads are formed on the outside of the container neck, spaced appreciably below the finish, to be engaged by internal thread lugs of the plastic cap. On initial unscrewing of the cap, the disc breaks away from the remainder of the cap. A small vertical clearance is provided in the engagement between the internal cap structure and the gasket/stopper, so that the cap does not begin to lift the gasket/stopper until static friction against the elastomeric gasket/stopper has been overcome.

19 Claims, 4 Drawing Sheets

WINE BOTTLE CLOSURE

BACKGROUND OF THE INVENTION

This invention is concerned with closures for containers carrying liquids for human consumption. Specifically the invention relates to a closure having a tamper-evident feature with a virtually hermetic seal which can easily be removed by hand. In one aspect of the invention the closure is adapted for wine bottles and has been designed to provide an aesthetic image in keeping with quality wines and retaining the "ceremony" involved with opening a bottle of wine without the need for an opening instrument as is currently employed.

Throughout the world and for several centuries, wines have been contained in glass bottles with corks. Even today, wines of medium to high quality are still packaged in the same way, although some lower quality wines have screw-threaded closures or employ alternative packaging. Corks are traditionally manufactured in Portugal and come in a variety of grades, the quality of which is determined only visually. There is a shortage of high quality corks, making it difficult for smaller vintners to secure a cork of consistent quality. A percentage of wine becomes "corked" after filling, that is, tainted by cork taste due to imperfect corks. Although no accurate industry figure is available, 4% of production is not an unusual number. A fair percentage of wines sold commercially reach the consumer in a "corked" condition. Cork maintains a substantially hermetic seal if it is kept moist by storing the bottle on its side. However, if the cork dries out it will lose its hermeticity due to its open cellular nature. Some people believe this open cellular structure provides additional air pockets or even permits air exchange with exterior air, and that this will enhance the aging of wine, especially red wine; however, another school of thought also exists which believes that wine should be produced at the quality level required under controlled manufacturing circumstances and packaged in an hermetically sealed environment thereafter to ensure a consistent quality level to the consumer. Inevitably some aging, i.e. changes to the wine, will occur in the bottle whether the seal is hermetic or not.

The quality of corks varies greatly and as cork ages it deteriorates and eventually crumbles, prompting certain high quality producers such as Chateau Lafite-Rothschild (Chateau & Estates) to periodically send its staffers to key wine markets to recork older bottles for their customers. The reported fact that corkiness taints an estimated $2 billion to $3 billion worth of wine each year is staggering.

Additionally, recent reports from various vintners in the United States would indicate that there is a high percentage of leakers, the exact reason for which no one seems fully to understand. This is prompting various vintners to store bottles in an upright position, drying the cork, and thus affecting the long term hermeticity of the closure and reducing the long term shelf life of the beverage.

The problems associated with corks are well documented and several vintners have already begun to use alternative stoppers such as the synthetic cork "Cellukork" and a metal screw-threaded closure called "Vin-Lok".

The traditional lead capsule has also become a thing of the past due to the FDA's concerns regarding lead contamination. In response to this problem, many new capsule materials have recently been developed to overcome the problem, none being as easy to remove as the original lead product.

Further, there is a widely held opinion in the wine industry today that the traditional wine package is not "user friendly", in that a cork requires a tool to remove it from the bottle, deemed by some to be an unnecessary nuisance and a deterrent for many potential customers, including the elderly and those less mechanically inclined.

It is also clear that the traditional cork offers no protection whatsoever to tampering and that the package can easily be contaminated by use of a syringe, causing a considerable exposure and liability for wine producers.

It is an object of this invention to replace the traditional wine cork with a sanitary, safe, easily-used, tamper-evident closure which provides an hermetic seal, is aesthetically pleasing and maintains some semblance of the traditional ceremony involved with the opening of a bottle of wine.

SUMMARY OF THE INVENTION

The invention described herein overcomes the problems outlined above by means of a two-piece closure system which replaces the traditional wine cork and metal foil capsule. The cork is replaced by an elastomeric stopper, preferably based on an EVA copolymer similar to DuPont's Elvax, which engages onto the top of the bottle neck finish and also inserts into the neck of the bottle, as a plug or stopper. The stopper function is preferably not relied on to create a seal for the bottle, but it produces a "popping" sound when withdrawn, similar to a traditional wine cork.

Surrounding the stopper and the neck finish of the bottle is an essentially cylindrical plastic sleeve or capsule which is designed to simulate the appearance of the traditional metal foil capsule. This plastic capsule can be made of different skirt lengths dependent on the quality of the wine and the image required. The capsule is made by means of injection molding and will have a smooth and preferably glossy appearance. It can be made from polystyrene or polypropylene resin and can be decorated by a variety of different methods such as heat transfer labels, vacuum metalizing, hot foil stamping, or pad or screen printing. The plastic sleeve has internal thread lugs near its lower end which engage with short, coarse threads formed on the bottle neck.

In order to utilize the well-known advantages of a screw-threaded construction, but avoid the low-quality image of a conventional continuous screw threaded cap, continuous screw threading is avoided. The capsule's internal thread lugs engage in a multiple start coarse threading down the outer edge of the bottle neck finish, the positioning and design of which provide a decorative appearance.

At the top of the plastic sleeve is a round shear disc which is frangibly attached to the rest of the capsule, preferably integral with the capsule but with frangible areas or score lines. This center shear disc is secured, as by adhesion or other means, to the top of the stopper after the capsule has been fitted to the top of the bottle neck. The frictional resistance of the stopper to rotational torque is far greater than the strength of the frangible areas (score lines) which attach the shear disc to the capsule. Thus, once the capsule is rotated, the disc breaks away along the frangible areas and remains attached to the stopper, providing a tamper-evident feature in an entirely different manner than is currently employed by the soft drink/liquor industries in which an outer ring shears and drops down. Under lab conditions the elastomeric stopper in a preferred embodiment requires approximately 10 inch-pounds to rotate it in a glass bottle neck when it is not under load. However, when put under load by threads, the stopper requires in excess of 60 inch-pounds to cause rotation. It is the intention of the design that the frangible areas will break away between about 15 and 20 inch pounds of rotational torque, releasing the stopper from the outer capsule.

Thus, resealing the bottle cannot be accomplished without revealing that the bottle has once been opened.

A retaining engagement is provided between the capsule and the stopper, and this may comprise internal flanges or tabs which engage the external annulus of the stopper. A vertical clearance is intentionally provided in this engagement, to help assure that the capsule can rotate independent of the stopper and so that as the tamper-evident feature previously described is broken by this relative rotation, the capsule does not initially engage and lift the stopper. This permits the capsule easily to be opened manually without requiring excessive torque to overcome static load, since static sealing friction is first overcome by the initial unscrewing rotation of the capsule, and only after the capsule is already in motion does it apply force to lift the stopper. In fact the stopper is lifted off the bottle finish without rotation. This feature follows the teaching of application Ser. No. 217,458, filed Mar. 24, 1994 and assigned to the same assignee as the present invention.

Due to the positioning and length of the multiple start threads, the action required is one of twisting followed by a pulling motion which creates a plopping sound as the stopper is withdrawn from the bottle. This action and sound (vacuum break) is specifically intended to simulate the current effect in removal of a cork in opening a bottle of wine.

The closure assembly of the invention allows resealing of the wine bottle, but as noted the fact that the bottle has once been opened will be evident.

Although the closure design of the invention is particularly aimed at wine packaging, the principles involved can be employed for other consumable liquids as well, particularly where an hermetic seal and a tamper-evident feature are desirable.

It is therefore among the principal objects of the invention to provide a practical and cost-effective alternative to the traditional wine cork and foil closure, with a sanitary, reliable stopper and connected capsule which provide both a tamper-evident and resistant feature coupled with an hermetic seal, while preserving the appearance and feel of the traditional wine cork and opening procedure. The invention encompasses a wine bottle of prescribed configuration, as well as the closure. These and other objects, advantages and features of the invention will be apparent from the following description of a preferred embodiment, considered along with the accompanying drawings.

DESCRIPTION OF PREFERRED EMBODIMENTS

Figure 1:
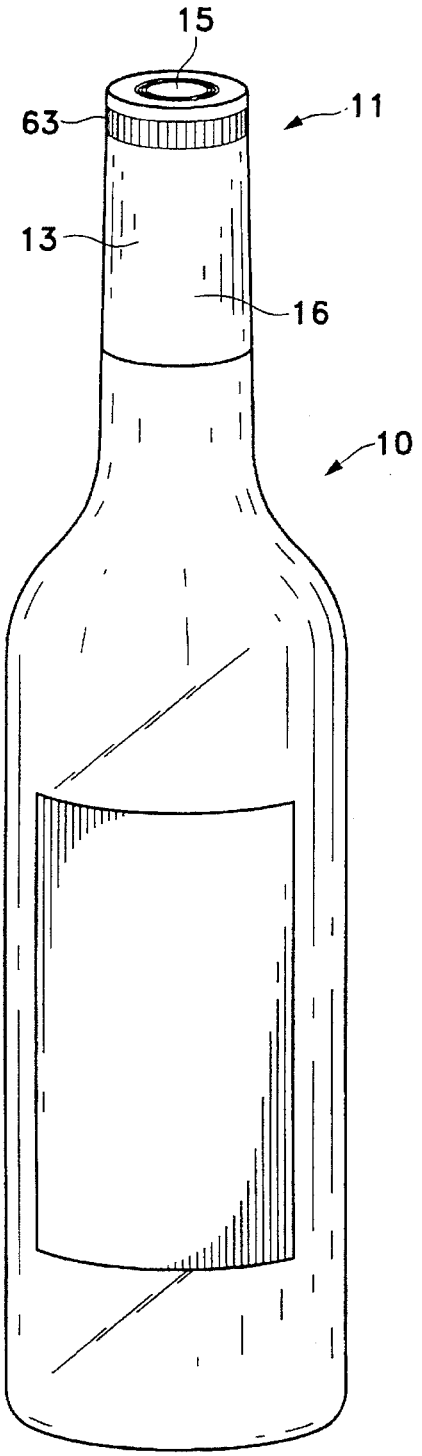
FIG. 1 is an elevation/perspective view showing a bottle, such as a wine bottle, fitted with the closure apparatus of the invention.

FIG. 1 shows in perspective a bottle 10 containing a liquid for consumption, such as wine. Sealing of the bottle 10 is by a closure assembly generally identified as 11. As can be seen from FIG. 1, the closure assembly 11 includes a generally tubular, closed-topped sleeve member or outer closure capsule 13 which fits over and encases the finish and a portion of the neck of the bottle 10. The sleeve member or capsule 13, which is formed of an injection moldable plastic such as polystyrene, polypropylene or polyester, includes an integral but frangible top center disc 15 which breaks away from the remainder of the capsule 13 when the capsule is initially unscrewed on the bottle 10.

As can be seen from FIG. 1, the plastic closure capsule 13, which can have a metallized surface if desired, simulates the appearance of the traditional cork wine bottle having a metal foil capsule covering the upper end of the neck. In part for this purpose, the capsule 13 includes a generally cylindrical and somewhat elongated skirt 16 which extends down the bottle neck in a manner similar to a bottle foil. The height of the capsule can be about 2¼ inch, for example; it should be a minimum of one inch in height and preferably at least about 1½ inches. Its length can vary according to the quality of the wine; longer corks are often used for higher quality wines to provide a better seal, and the foil generally extends to below the cork.

Figure 2:
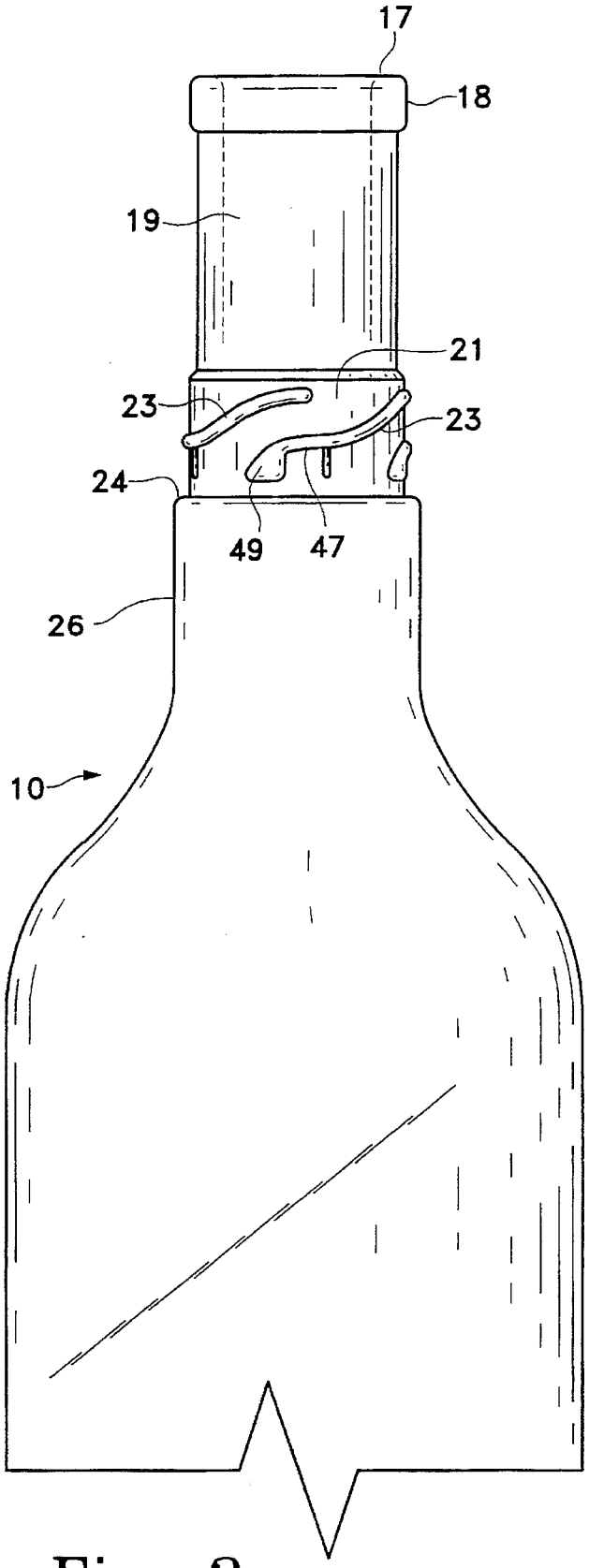
FIG. 2 is a detail view in elevation, showing the neck of the bottle with the closure removed, revealing a preferred configuration according to the invention.

FIG. 2 shows a bottle 10 in elevation, with an example of a configuration which can be employed for the closure system described. The closure itself is not shown in FIG. 2. As illustrated, the bottle 10 has a finish 17 which may be of approximately the same diameter as used in traditional cork-sealed wine bottles. The finish can include a transfer bead/pour lip 18, as on a traditional wine bottle. Below the finish, the bottle's neck 19 extends down to a region 21 which may be slightly greater in diameter and which bears threads 23 as shown. Shown below this thread region 21 is a ledge 24 and a lower neck region 26.

The bottle 10 preferably is formed of glass, particularly for containing wine, but plastics can be used for specific purposes if desired.

Figure 3:
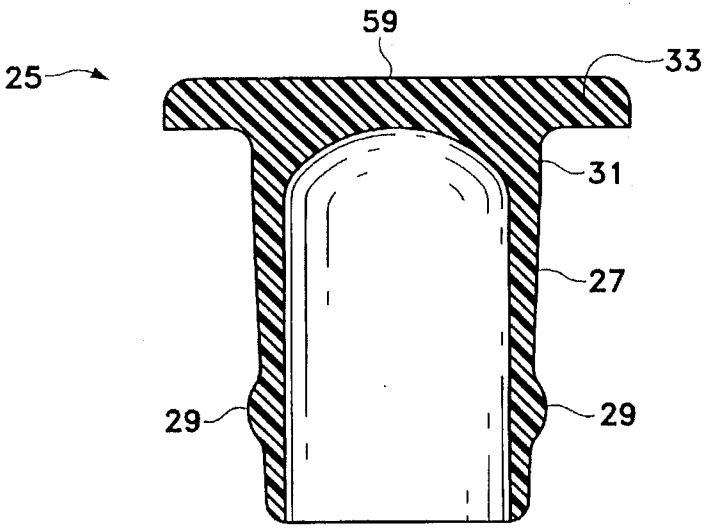
FIG. 3 is a detail view showing one preferred form of stopper which forms a part of the closure.

FIG. 3 shows, in an enlarged view, an elastomeric gasket and stopper 25 which forms a part of the closure assembly. The stopper 25 has an exterior surface 27 which fits snugly into the internal diameter of the bottle neck 19. As can be seen in FIG. 3, the stopper has a tapered exterior surface, except that a rounded bead 29 is included ¼ inch to ½ inch up from the bottom, to form an interference fit with the interior of the bottle neck. FIG. 3 shows that, at an upper area 31 of the stopper, the diameter of the stopper is similar to that of the interference bead 29, so that again, the stopper will fit tightly into the bottle.

The stopper 25 can advantageously be formed of an EVA copolymer such as the material Elvax manufactured by DuPont, in formulations designed to permit no gas exchange or virtually no gas exchange, particularly oxygen exchange. This material is a thermoplastic elastomer (TPE), having the advantages of being injection moldable and having elastomeric properties. The EVA copolymer is relatively inert and produces exceptional barrier properties. As can be seen, the stopper 25 has an enlarged annular flange 33 or sealing gasket forming a lip which seals against and overhangs beyond the top finish 17 of the bottle to a small extent, e.g. about 0.03 to 0.06 inch, preferably about 0.05 inch, around the periphery (total outside diametric difference of about 0.10 inch). The purpose of this overhang is to engage with the plastic capsule member 13 which is detailed in FIGS. 5–8. As shown in FIG. 6, revealing the closure capsule or sleeve in cross section, at the upper end of the capsule is a recess or cavity 35, formed at its lower side by a ledge 37 of the integrally molded capsule 13. The ledge 37, which may be annular or may comprise a series of lugs 37*a* as shown, preferably defines an internal diameter about 0.10 inch less than the larger diameter in the cavity 35. This allows the ledge to capture the plug or stopper 25 via its flange or lip 33, to the extent that when the capsule 13 is raised on the bottle, the stopper is pulled out of the neck of the bottle. This degree of diameter difference permits the elastomeric stopper to be forced and snapped into the closure capsule upon assembly.

In one preferred embodiment of the invention, the stopper or plug 25 has an outer lip or flange diameter of about 1.15 to 1.16 inch, with a diameter at the sealing bead 29 and at the upper area 31 of about 0.770 to 0.775 inch. The height of the stopper may be about 1.15 inch, with the lip 33 having a height or thickness of about 0.135 to 0.140 inch, and with a radius 38 at the outer edge, preferably about 0.062 inch, to facilitate snapping the stopper past the lugs 37*a*. This assumes that the material from which the stopper is made is as identified above. With these dimensions the EVA copolymer stopper has a strong dip which will allow the stopper to be pulled out of the bottle without distorting or slipping out of the retaining lugs 37*a*. Vertical clearance between the stopper lip 33 and the capsule cavity 35 helps facilitate assembly.

Also in this preferred embodiment, the inside diameter of the cavity or recess 35 may be about 1.18 to 1.19 inch, while the internal ledge 37 diameter is about 1.08 to 1.09 inch. The height of the plastic capsule 13 may be about 2.25 inch, although this can vary considerably (and can be varied in accordance with wine quality level). The internal diameter 39 of the plastic capsule, below the ledge 37 (FIG. 6), preferably tapers somewhat as illustrated, becoming larger toward the lower end. At a transition level 41, which may be about 0.75 inch above the bottom of the cap, the internal diameter becomes larger, and this diameter may be about 1.20 to 1.21 inch, to accommodate the threaded region 21 of the bottle as shown in FIG. 1. Of course, it will appreciated that these design features, although preferred in this embodiment, can be varied depending on the diameters and other dimensions selected for the bottle itself.

Primary sealing of the bottle is accomplished by the sealing gasket 33 or lip of the stopper, engaged tightly against the bottle finish as explained further below. The elastomeric properties of the gasket are important for effective sealing under load. As is well know, elastomers displace rather than compress under load.

FIG. 6 also reveals internal bosses 43 serving as thread lugs of the plastic capsule 13, near the bottom of the larger diameter region 45. Each of these thread lugs 43, of which there may be four, is at the same level in this preferred form of the invention, to act as multiple start threads in engaging with the interrupted bottle threads 23 shown in FIGS. 2 and 4. The bottle threads 23 are equally spaced around the region or collar 21 of the bottle, such that the thread lugs 43 of the capsule 13 will each engage a particular one of the these threads 23 and with a rotation of about one-quarter turn, the thread lugs will lock into position under a generally horizontal region 47 of each bottle thread. A stop 49 is included at the end of each thread, to define a hard stop position for rotation of the capsule 13 and thus to provide a pre-engineered preload on the elastomeric plug to ensure sealing.

Figure 4:
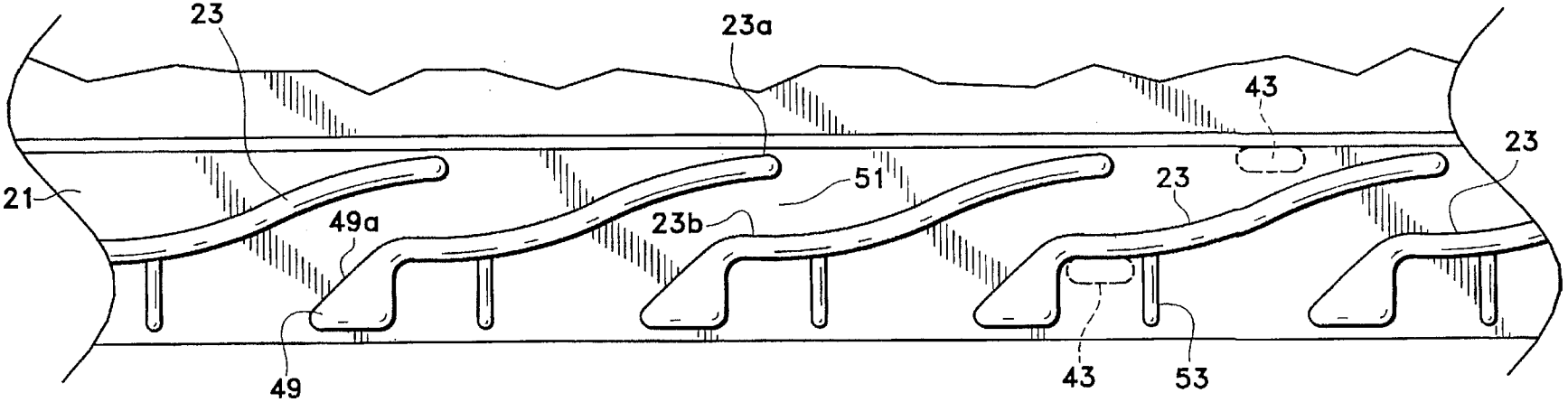
FIG. 4 is a detail view, showing one preferred form of threads formed on the container, shown developed.
Figure 8:
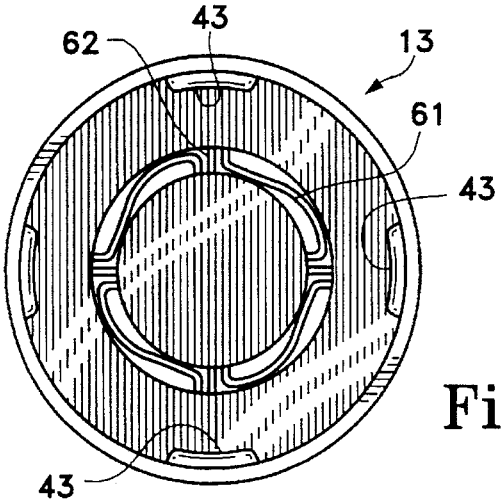
FIG. 8 is a bottom plan view of the plastic capsule, revealing thread lugs on the interior of the capsule's skirt.

FIG. 4 shows the bottle threads 23 and the thread collar region 21 of the bottle in greater detail, developed in a plan view. As can be seen from the developed view, the curvature of the threads 23 is much more gradual than what appears in the elevational view of FIG. 2. The threads 23 are shaped so as to create considerable mechanical advantage when the closure capsule is engaged on the bottle and twisted. As can readily be appreciated, each of the four thread lugs 43 of the closure capsule engages into a gap 51 between the initial end 23*a* of one thread and the upper side 23*b* of the terminal end of an overlapping thread below. When the capsule is rotated, the ramp effect along the underside of the thread 23 pulls the closure downwardly. Each of the lugs 43 (shown in dashed-line positions in FIG. 4) crosses over a locking bar or boss 53 which is formed as a shallower, less-relieved extension of the threads 23. As an example, the threads 23 may have a protruding dimension of about 0.050 inch, while the locking bars or bosses 53 may have a protruding dimension of about 0.024 inch. This latter dimension is sufficient to interfere with the diameter defined between opposed thread lugs 43 as seen in FIG. 6 and FIG. 8. This effective diameter may be, for example, about 1.19 to 1.20 inch. The locking bar interference is small, and can be about 0.005 to 0.010 inch. This occasions a twisting force required to snap the plastic closure capsule 13 past the locking bars 53, to engage them in the thread lug regions 47. The thread lugs 43 are sized to fit relatively closely between the interference or locking bars 53 and the terminal end stop 49 of each thread 23, as indicated in dashed lines in FIG. 4. The inherent resilience of the plastic material from which the capsule 13 is made is sufficient to allow this interference and "snapping" fit to engage the plastic closure capsule 13 onto the bottle. The main purpose of the locking bars is to resist back-off, which tends otherwise to occur because of the low friction coefficient of glass and the tendency of thermoplastics to cold flow.

As seen in FIG. 4, the stop portion 49 of each thread extends obliquely, e.g. at 45° to horizontal, so as to provide a ramp at the upper surface 49*a* to lift the capsule 13 unless rotated in an unscrewing motion. At the same time the stop portion 49 serves as a hard stop as noted above, when the capsule is screwed down.

From the drawings it can be appreciated that the bottle neck threads do not appear as normal threads to the observer.

Figure 5:
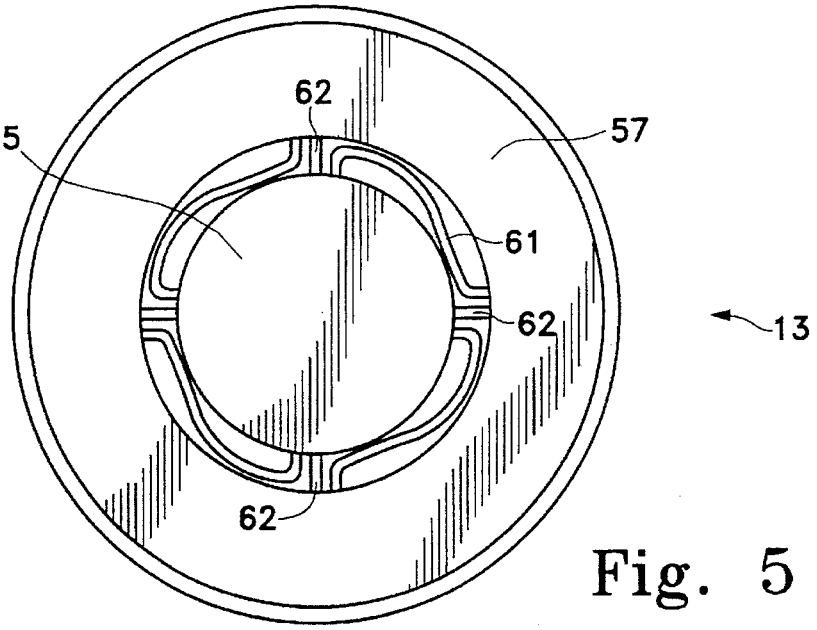
FIG. 5 is a detail plan view showing a frangible connection between a sleeve and the stopper of the wine closure assembly.
Figure 6:
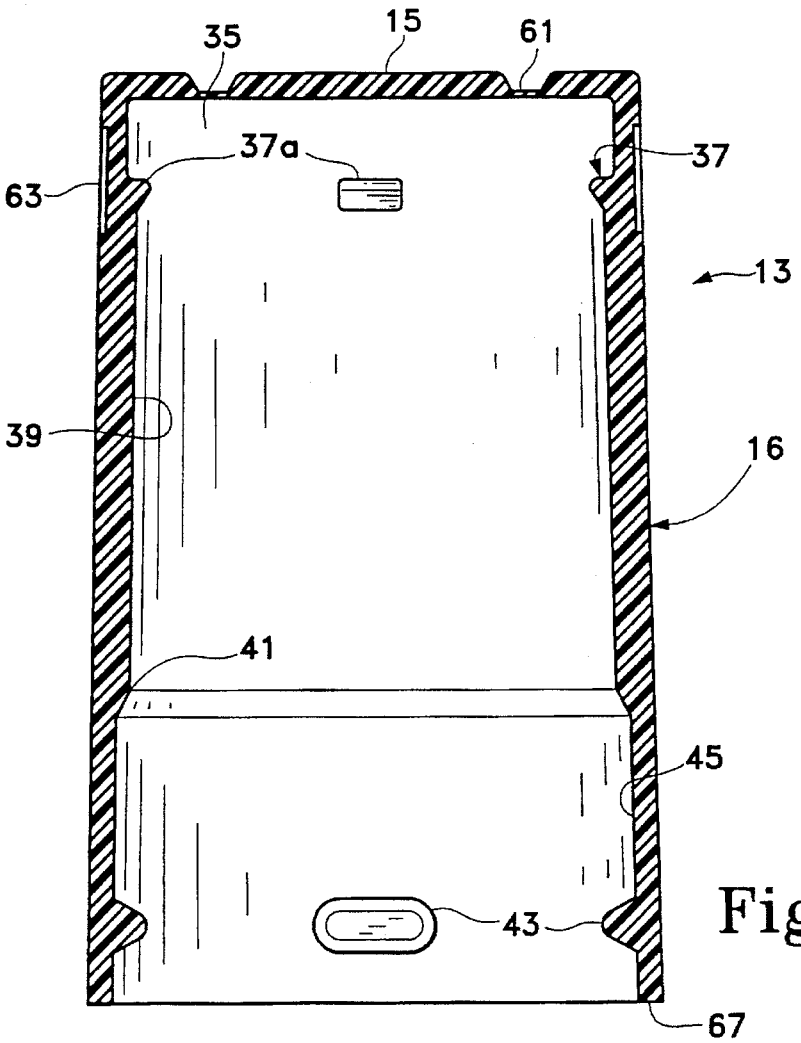
FIG. 6 is an elevational section view of the sleeve or capsule which engages with the bottle, and forms the outer element of the closure assembly.
Figure 7:
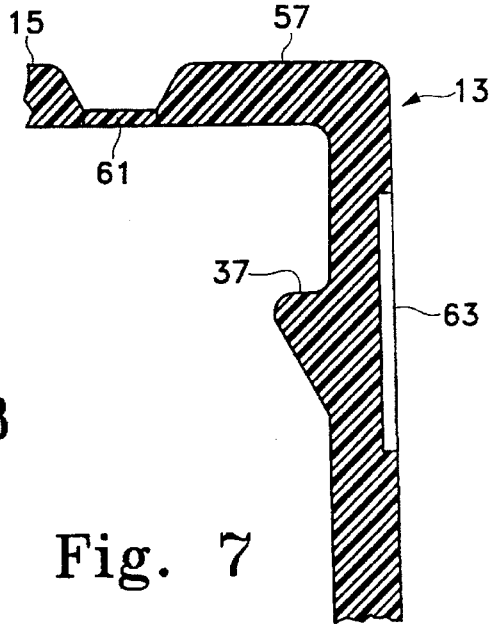
FIG. 7 is an enlarged detail view showing a portion of the plastic capsule member.

FIG. 5 shows the plastic closure capsule or outer capsule 13 in top view. The top of the plastic shoulder has a preferably flat annular area 57 which surrounds an inner disc 15 designed to be broken away from the area 57 when the closure device 13 is unscrewed. See also FIG. 7. A narrow region 61 of much thinner material is formed in preferably sinuous lines in four sections as shown in FIG. 5. FIG. 7 shows that these regions 61 are far thinner than the remainder of the closure such as at 15 and 57, being approximately one-fourth the thickness, as an example, so that these regions provide a frangible "seal" between the central disc 15 and the outer annulus 57 which deforms permanently when the closure capsule 13 is twisted relative to the bottle. For this purpose the central break-away disc 15 is secured to the gasket/stopper 25, i.e. to a central area 59 at the top of the stopper (see FIG. 3). This may be by a heat-induction foil. An adhesive of high shear strength secures the foil to the break-away shear disc 15. The foil is subsequently, after capping, sent through a heat induction machine which adheres it to the EVA stopper 25 essentially attaching the stopper to the shear disc. This allows the closure to be screwed onto the bottle without the disc bonded to the stopper and thus without having to overcome high friction of the stopper lip against the bottle finish. The resistance of the stopper under load can be in excess of 60 inch-pounds, and to attempt tightening the closure with the stopper already secured could damage the stopper lip or break the "seal" formed by the sinuous frangible elements 61. Note that the induction foil also provides additional barrier properties.

The primary attachment of the central disc 15 of the closure to the surrounding annulus 57 is by a series of connecting tabs 62. These may be positioned, as shown in FIG. 5, between ends of adjacent sinuous members 61. Upon initial unscrewing rotation of the closure, these tabs (which may be four in number, as shown) immediately break. The tabs 62 may be designed to shear between about 15 and 20 inch-pounds. Further unscrewing motion twists and distorts the thin sinuous members 61, causing permanent distortion as noted above and indicating the bottle has been opened.

As noted earlier, the primary sealing of the bottle is made, in the preferred embodiment, by the compression of the outer flange or lip 33 of the elastomeric gasket/plug 25 down against the bottle finish, rather than by the insertion of the stopper or plug 25 itself into the bottle neck. When the plastic closure capsule 13 is lowered over the bottle neck and screwed into place, through rotation of about one-quarter turn, this pulls the top of the plastic closure down against the elastomeric plug lip 33 (with the capsule slipping relative to the plug), thus preloading the stopper against the bottle finish by 0.030 to 0.040 inch. Static friction is thus created between the stopper and the bottle finish which will resist rotation when the plastic capsule 13 is unscrewed. The pre-loading friction of the stopper against the bottle finish is sufficient to resist rotation even though the central break-away disc 15 of the closure is now adhered to the stopper itself. Thus, the frangible tabs 62 of the plastic outer capsule 13 will break under the twisting shear, with the disc 15 held in place by the stopper and its friction with the bottle. The sinuous members 61 distend and distort. Once the disc 15 is broken free of the plastic closure, the closure is unscrewed the remainder of an approximate one-quarter turn. As can be seen from the developed thread view in FIG. 4, this will free the thread lugs 43 of the plastic closure from the threads 23 on the bottle, such that the closure can be lifted free. Further rotation will permit the thread lugs to ride along the top edge of the succeeding threads as can be seen from FIG. 4, helping provide leverage for lifting of the stopper out of the bottle. In any event, once the thread lugs are clear of the confines of the threads 23, the closure can be lifted from the bottle, pulling the stopper out of the bottle via the gripping of the stopper lip 33 by the annular ledge 37 of the plastic closure capsule.

A clearance is provided in the engaging relationship between the cavity or recess 35 of the plastic closure member (FIGS. 6 and 7) and the thickness of the gasket lip or flange 33. In other words, the gasket edge or flange 33 fits between the top of the closure 13 and the ring-shaped ledge 37 with some degree of vertical clearance, which may be about 0.025 to 0.030 inch. Sufficient clearance should be provided to enable slipping of the capsule relative to the stopper. This enables the plastic closure 13 to be rotated to break the seal or tamper-evident feature at the disc 15, and then to release remaining pre-load on the stopper through continued rotation of the plastic closure 13, to thus overcome substantially all rotational friction, before the closure 13 engages and lifts the stopper. Accordingly, the stopper stays stationary, without rotation, through substantially the entire one-quarter rotation of the closure 13. This is important in eliminating the requirement for a high torque in removing the closure. Torque used to initially free the plastic closure 13 from thread engagement friction and from the disc seal does not at the same time need to overcome static friction of the elastomeric seal against the bottle finish. In other words, if the elastomeric stopper were permanently affixed to the interior top of the plastic capsule 13, then the twisting of the closure 13 would have to rotationally overcome the static load existing between the stopper and the bottle finish, requiring a very much greater torque, as explained above (over 60 inch pounds). Without downward load the stopper alone would require only about 8 to 10 inch-pounds to be rotated. In the assembly as described, the stopper remains stationary with the bottle until a point when the plastic closure device 13 has already been freed from frictional engagement.

It is apparent that the frangible disc 15 forms a tamper-evident feature with the remainder of the closure. Once the frangible areas 61 and 62 have broken, they will be distorted and will not resume the same position even if the closure 13 is replaced and the stopper pushed back into the bottle. The sinuous members 61 give an obvious visual indication.

As shown in FIGS. 1, 6 and 7, a knurled or serrated band 63 preferably is formed along the exterior of the plastic closure member 13, for assisting in manual gripping and twisting of the closure. As an aesthetic feature this band 63 also imitates crimping of a metal foil as found on some other types of closures.

Figure 9:
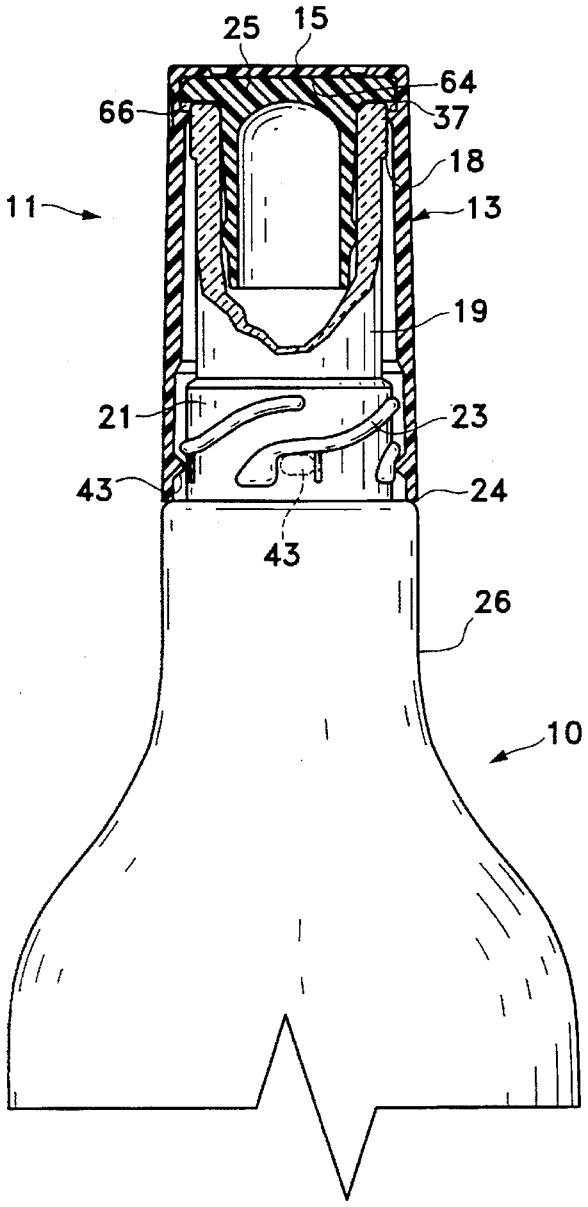
FIG. 9 is an elevational section view showing the closure as assembled on the bottle, with part of the bottle's neck finish shown broken away.
Figure 9A:
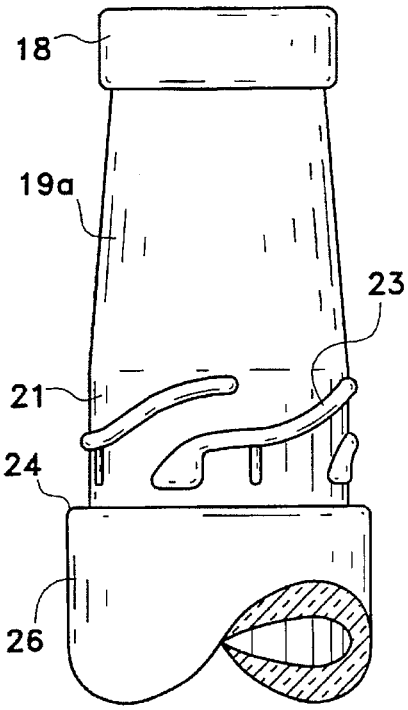
FIG. 9A is a view similar to FIG. 9 but showing an alternative shape of the bottle neck finish.

FIG. 9 shows the assembly of the closure 11 and bottle 10. An area of adhesion, which may be via an induction foil as discussed above, is shown at 64. A small clearance, although somewhat difficult to discern in the drawing, is shown at 66 between the ledge 37 of the closure capsule and the top of the recess of the cap, within which the gasket/plug 25 resides. Thread lugs 43 are shown in position beneath the threads 23 of the bottle. FIG. 9 shows the transfer bead 18 (also serving as a pouring lip) contained within the capsule 13. In FIG. 9 the bottle neck 19 just below this bead 18 descends generally vertically to the expanded-diameter region 21 as in FIG. 2; in the alternative form of FIG. 9A the neck 19*a* tapers outwardly in the descending direction to smoothly meet the region 21.

Although the bottle 10 shown in FIGS. 1 and 2, which may be a wine bottle, has a protrusion or ledge 24 at which the diameter of the bottle increases considerably (e.g. from about 1.160 inch to about 1.412 inch), to approximately match the external diameter of the screw-on plastic closure 13, this is a preferred but optional feature. Alternatively, the ledge area 24 can be of a lesser diameter, the same or slightly greater diameter than the thread area 21, and a relatively thin cylindrical bottom end 67 of the plastic closure 13 can extend down further, to just surround the neck or shoulder of the bottle. Other configurations are possible as well, one principal goal being to preserve the aesthetic appearance of the closure in the case of a wine bottle. It is also noted that the bead 18 at the top of the bottle neck can be spaced down slightly to imitate the most common traditional configuration; and a similar bead, for aesthetics only, can be formed into the outside surface at the plastic capsule 13 in the injection molding process, if desired.

The above described preferred embodiments are intended to illustrate the principles of the invention, but not to limit its scope. Other embodiments and variations to this preferred embodiment will be apparent to those skilled in the art and may be made without departing from the spirit and scope of the invention as defined in the following claims.

I claim:

1. A wine bottle and closure combination, comprising:

a wine bottle in the general shape and appearance of a wine bottle, and having a neck with a finish and external threads near an upper end, a closure for the wine bottle, of size and configuration as to fit together in sealed relationship with the bottle, the closure including (a) a plastic closure capsule with a generally horizontal top portion and an integral, elongated and generally cylindrical depending skirt portion having internal threads complementary to the external threads of the bottle such that the closure capsule can be screwed down onto the bottle, (b) a sealing gasket positioned below the underside of the generally horizontal top portion of the closure capsule in position to engage the upper edge of the bottle's finish, said gasket being, at least in an annular area over the bottle's finish, not secured fast to the closure capsule, (c) the closure capsule having engagement means on a lower side of said top portion, above said annular area of the sealing gasket, for engaging downwardly against the sealing gasket when the closure capsule is screwed down onto the bottle, and (d) connection means between the closure capsule and the sealing gasket, for retaining the sealing gasket with the closure capsule while also providing a vertical clearance between the closure capsule and the sealing gasket such that the closure capsule engages downwardly against the sealing gasket when the closure capsule is screwed downwardly on the wine bottle and lifts upwardly on the sealing gasket when the closure capsule is unscrewed upwardly, the vertical clearance providing that for a portion of its rotational and vertical travel in unscrewing from the bottle the closure capsule is capable of rotation independently of the sealing gasket, whereby the closure capsule may be screwed onto the wine bottle to press the sealing gasket down against the upper edge of the bottle's finish to tightly and sealingly engage the sealing gasket against the finish without rotation of the sealing gasket on the finish, the closure capsule slipping rotationally relative to the sealing gasket as the closure capsule is tightened down in engagement with the sealing gasket, and whereby, upon opening of the closure, initial unscrewing rotation of the closure capsule is accomplished with the closure capsule slipping relative to the sealing gasket, which initially remains stationary on the bottle's finish as the closure capsule rises through the vertical clearance, then the sealing gasket is engaged upwardly by the closure capsule and is lifted upwardly off the bottle's finish by the closure capsule as the closure capsule is further unscrewed upwardly, thus enabling the closure to be removed without having to rotationally overcome static friction of the gasket with the bottle's finish.

2. The wine bottle and closure combination of claim 1, wherein the connection means between the closure capsule and the sealing gasket comprises the sealing gasket's having an overhanging lip which extends beyond the outer diameter of the bottle's finish, and the closure capsule having an internal cavity within which the sealing gasket and overhanging lip reside, including ledge means on the interior of the closure capsule positioned below the underside of the overhanging lip, the ledge means being spaced from the engagement means of the closure capsule a preselected distance so as to define said vertical clearance.

3. The wine bottle and closure combination of claim 1, wherein the sealing gasket includes an integrally formed and downwardly extending stopper portion having an external surface sized to be received in the neck of the bottle with an interference, friction fit.

4. The wine bottle and closure combination of claim 1, wherein the closure capsule includes, as part of the top portion, a frangibly connected central top disc with means for breaking away from the remainder of the closure capsule when subjected to rotational shear stress, said frangible central top disc being secured to the top of the sealing gasket on the closed wine bottle with a heat induction connection made after the closure is screwed onto the bottle, whereby upon initial unscrewing of the closure capsule from the bottle, the sealing gasket remains stationary relative to the bottle's finish due to static friction against the finish, and the frangible central top disc of the closure capsule breaks away from the closure capsule and remains with the sealing gasket.

5. The wine bottle and closure combination of claim 4, wherein the top portion of the closure capsule further includes tamper-evident means for giving a clear visual indication when the closure has been removed from the bottle.

6. The wine bottle and closure combination of claim 5, wherein the tamper-evident means comprises a series of sinuous frangible strips positioned between and connected at ends to the central top disc and the remainder of the closure capsule, in positions to be distorted permanently when the central top disc breaks away from the remainder of the closure capsule.

7. The wine bottle and closure combination of claim 1, wherein the closure capsule is at least about one inch in height.

8. The wine bottle and closure combination of claim 7, wherein the closure capsule is at least about one and one-half inch in height.

9. The wine bottle and closure combination of claim 7, wherein the exterior of the closure capsule has substantially an appearance of a traditional wine bottle foil.

10. The wine bottle and closure combination of claim 1, wherein the capsule's skirt portion has a bottom edge and wherein the neck of the wine bottle has an annular ledge just below the the bottom edge of the capsule's skirt portion, the ledge having an outer diameter approximately the same as the outer diameter of the bottom edge of the capsule's skirt portion, such that a generally continuous outer surface is presented down the neck of the bottle, along the exterior of the closure capsule and the exterior of the bottle neck immediately below the closure capsule.

11. The wine bottle and closure combination of claim 1, wherein the sealing gasket is formed of a TPE material, injection moldable and having elastomeric properties.

12. The wine bottle and closure combination of claim 11, wherein the sealing gasket includes an integrally formed and downwardly extending stopper portion having an external surface sized to be received in the neck of the bottle with an interference, friction fit.

13. The wine bottle and closure combination of claim 1, wherein the closure capsule is formed of an injection-moldable plastic selected from the group consisting of polystyrene, polypropylene and polyester.

14. The wine bottle and closure combination of claim 1, wherein the threads of the wine bottle and of the closure capsule include snap locking means for defining a position beyond which the capsule must be screwed before it is fully tightened onto the bottle, the snap locking means providing resistance against backing off of the closure.

15. A wine bottle and closure combination, comprising:

a wine bottle in the general shape and appearance of a wine bottle, containing wine, and having a neck with a finish and external threads near an upper end, a closure for the wine bottle, of size and configuration as to fit together in sealed relationship with the bottle, the closure including (a) a closure capsule with a generally horizontal top portion and an integral, elongated and generally cylindrical depending skirt portion having internal threads complementary to the external threads of the bottle such that the closure capsule can be screwed down onto the bottle, the closure capsule being at least about one inch in height, (b) a sealing gasket positioned below the underside of the generally horizontal top portion of the closure capsule in position to engage the upper edge of the bottle's finish, (c) the sealing gasket including an integrally formed and downwardly extending stopper portion having an external surface sized to be received in the neck of the bottle with an interference, friction fit, (d) means on the closure capsule for retaining the sealing gasket with the closure capsule upon removal of the closure capsule from the bottle, and (e) the exterior of the closure capsule having substantially an appearance of a traditional wine bottle foil, with the capsule's skirt portion having a bottom edge and the neck of the wine bottle having an annular ledge just below the bottom edge of the capsule's skirt portion, the ledge having an outer diameter approximately the same as the outer diameter of the bottom of the capsule's skirt portion, such that a generally continuous outer surface is presented down the neck of the bottle, along the exterior of the closure capsule and the exterior of the bottle neck immediately below the closure capsule.

16. The wine bottle and closure combination of claim 15, wherein the closure capsule is at least about one and one-half inches in height.

17. The wine bottle and closure combination of claim 15, wherein said threads of the wine bottle and of the closure capsule comprise interrupted, multiple start threads, whereby removal of the closure requires a limited twisting of the closure followed by a pulling motion which creates a plopping sound as the stopper portion of the sealing gasket is withdrawn from the bottle.

18. The wine bottle and closure combination of claim 15, wherein the sealing gasket, at least in an annular area over the bottle's finish, is not secured fast to the closure capsule, and wherein the closure capsule includes, as part of the top portion, a frangibly connected central top disc with means for breaking away from the remainder of the closure capsule when subjected to rotational shear stress, said frangible central top disc being secured to the top of the sealing gasket on the closed wine bottle with a heat induction connection made after the closure is screwed onto the bottle, whereby upon initial unscrewing of the closure capsule from the bottle, the sealing gasket remains stationary relative to the bottle's finish due to static friction against the finish, and the frangible central top disc of the closure capsule breaks away from the closure capsule and remains with the sealing gasket.

19. The wine bottle and closure combination of claim 18, wherein the top portion of the closure capsule further includes tamper-evident means for giving a clear visual indication when the closure has been removed from the bottle.

* * * * *